US010127854B2

(12) United States Patent
Yang et al.

(10) Patent No.: US 10,127,854 B2
(45) Date of Patent: Nov. 13, 2018

(54) DISPLAY DRIVING METHOD, APPARATUS AND DISPLAY DEVICE THAT GENERATES ANANALOG POWER SUPPLY VOLTAGE FOR A SOURCE DRIVER CHIP ACCORDING TO BRIGHTNESS OF SUB-PIXELS

(71) Applicant: BOE TECHNOLOGY GROUP CO., LTD., Beijing (CN)

(72) Inventors: Fei Yang, Beijing (CN); Szu Heng Tseng, Beijing (CN); Yue Wu, Beijing (CN); Song Meng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 7 days.

(21) Appl. No.: 15/219,707

(22) Filed: Jul. 26, 2016

(65) Prior Publication Data

US 2017/0069251 A1 Mar. 9, 2017

(30) Foreign Application Priority Data

Sep. 7, 2015 (CN) ..... 2015 1 0564797

(51) Int. Cl.

*G09G 5/02* (2006.01)
*G09G 3/20* (2006.01)
*G09G 3/36* (2006.01)

(52) U.S. Cl.

CPC ..... *G09G 3/2074* (2013.01); *G09G 3/2003* (2013.01); *G09G 3/3696* (2013.01); *G09G 2300/0452* (2013.01); *G09G 2320/0233* (2013.01); *G09G 2320/0626* (2013.01);
(Continued)

(58) Field of Classification Search

None
See application file for complete search history.

(56) References Cited

U.S. PATENT DOCUMENTS

2003/0122807 A1 7/2003 Kataoka et al.
2010/0134472 A1* 6/2010 Chang ..... G09G 5/10 345/212

(Continued)

FOREIGN PATENT DOCUMENTS

CN 101751842 A 6/2010
CN 102456309 A 5/2012
CN 102956173 A 3/2013

(Continued)

OTHER PUBLICATIONS

Chinese Office Action dated Apr. 25, 2016.

*Primary Examiner* — Abdul-Samad A Adediran
*Assistant Examiner* — Kirk Hermann
(74) *Attorney, Agent, or Firm* — Dilworth & Barrese, LLP.; Michael J. Musella, Esq.

(57) ABSTRACT

The present disclosure provides a display driving method, apparatus and a display device. The method comprises: acquiring pixel data of N pixels, N=i*j, i being a coefficient and being a positive integer, and j being the number of pixels in each row; determining, for each pixel data, brightness values of respective sub-pixels in a pixel corresponding to the pixel data; calculating an analog power supply voltage of a source driver chip of a display module according to respective brightness values, the analog power supply voltage being positively correlated with the brightness values.

9 Claims, 5 Drawing Sheets

(52) U.S. Cl.
CPC ..... *G09G 2330/021* (2013.01); *G09G 2340/0457* (2013.01)

(56) References Cited

U.S. PATENT DOCUMENTS

2013/0147861 A1* 6/2013 Kim ..... G09G 5/10 345/690
2014/0354698 A1* 12/2014 Lee ..... G09G 3/3258 345/690

FOREIGN PATENT DOCUMENTS

| | | | | | |
|---|---|---|---|---|---|
| CN | 103165066 | A | | 6/2013 | |
| CN | 104200765 | A | | 12/2014 | |
| JP | 2001147666 | A | * | 5/2001 | ..... G09G 3/3607 |
| KR | 101373335 | B1 | | 3/2014 | |

* cited by examiner

DISPLAY DRIVING METHOD, APPARATUS AND DISPLAY DEVICE THAT GENERATES ANANALOG POWER SUPPLY VOLTAGE FOR A SOURCE DRIVER CHIP ACCORDING TO BRIGHTNESS OF SUB-PIXELS

PRIORITY CLAIM

The present disclosure claims priority of a patent application with title of "DISPLAY DRIVING METHOD, APPARATUS AND DISPLAY DEVICE" submitted by the present applicant on Sep. 7, 2015 in China, which is hereby incorporated by reference in its entirety.

TECHNICAL FIELD OF THE DISCLOSURE

The present disclosure relates to the field of display technology, and in particular, to a display driving method, apparatus and a display device.

BACKGROUND

In the display field, the higher the desired brightness of a display screen is, accordingly, the greater the analog power supply voltage of a source driver chip of a display module must be. Thus, in order to ensure that the display screen can emit light with maximum brightness, the analog power supply voltage of the source driver chip is generally set to the voltage corresponding to the maximum brightness.

However, when the source driver chip operates at a voltage corresponding to the maximum brightness, power consumption of the source driver chip is high.

SUMMARY

Embodiments of the present disclosure provide a display driving method, apparatus and a display device. According to a first aspect of embodiments of the present disclosure, there is provided a display driving method, comprising:

acquiring pixel data of N pixels, N=i*j, i being a coefficient and being a positive integer, and j being the number of pixels in each row;

determining, for each pixel data, brightness values of respective sub-pixels in a pixel corresponding to the pixel data;

calculating an analog power supply voltage of a source driver chip of a display module according to respective brightness values, the analog power supply voltage being positively correlated with the brightness values.

Alternatively, said determining, for each pixel data, brightness values of respective sub-pixels in a pixel corresponding to the pixel data comprises:

converting a gray scale input value in each pixel data into brightness values of at least three types of sub-pixels, the at least three types of sub-pixels comprising: a sub-pixel R, a sub-pixel G and a sub-pixel B; or a sub-pixel R, a sub-pixel G, a sub-pixel B and a sub-pixel W; or a sub-pixel R, a sub-pixel G, a sub-pixel B and a sub-pixel Y.

Alternatively, said calculating the analog power supply voltage of a source driver chip of a display module according to respective brightness values comprises:

querying a voltage value corresponding to each brightness value according to a preset correspondence between the brightness values and the voltage values;

selecting, for each type of sub-pixel, a maximum voltage value from N voltage values corresponding to N brightness values of this type of sub-pixel;

calculating the analog power supply voltage according to the selected maximum voltage values of the sub-pixels of different types.

Alternatively, said analog power supply voltage $V_{AVDD}$ is that $V_{AVDD}=k*\mathrm{Max}\ (V_{S_{1max}}+V_{S_{2max}}+\ldots+V_{S_{nmax}})+b$;

wherein it is assumed that sub-pixels of different types are $S_1$, $S_2$, . . . $S_n$ respectively; the maximum voltage values corresponding to sub-pixels of respective types are $V_{S_{1max}}$, $V_{S_{2max}}$, . . . , $V_{S_{nmax}}$ respectively; n is the number of Sub-pixel types, and k and b are constants.

Alternatively, before said calculating the analog power supply voltage of a source driver chip of a display module according to respective brightness values, the method further comprises:

calculating, for each pixel data, a total brightness value of the pixel corresponding to the pixel data according to the brightness values of respective sub-pixels in the pixel corresponding to the pixel data;

determining the number of total brightness values higher than a preset threshold among N total brightness values;

reducing, if a ratio of the number to N is less than a preset ratio, the total brightness values higher than the preset threshold to the preset threshold;

calculating brightness values of respective sub-pixels in the corresponding pixel after the total brightness values are reduced to the preset threshold.

Alternatively, the method further comprises:

for each type of sub-pixel, selecting the maximum brightness value from N brightness values corresponding to this type of sub-pixel, and;

calculating, for each pixel data, a gray scale output value of this type of sub-pixel corresponding to the pixel data, according to the selected maximum brightness value, the brightness value of this type of sub-pixel corresponding to each pixel data and the number of bits of the pixel data According to a second aspect of embodiments of the present disclosure, there is provided a display driving apparatus, comprising:

a data acquisition module for acquiring pixel data of N pixels, N=i*j, i being a coefficient and being a positive integer, and j being the number of pixels in each row;

a brightness value determination module for determining, for each pixel data acquired by the data acquisition module, brightness values of respective sub-pixels in a pixel corresponding to the pixel data;

a voltage calculation module for calculating an analog power supply voltage of a source driver chip of a display module according to respective brightness values determined by the luminance value determination module, the analog power supply voltage being positively correlated with the brightness values.

Alternatively, the brightness value determination module is further used for:

converting a gray scale input value in each pixel data into brightness values of at least three types of sub-pixels, the at least three types of sub-pixels comprising: a sub-pixel R, a sub-pixel G and a sub-pixel B; or a sub-pixel R, a sub-pixel G, a sub-pixel B and a sub-pixel W; or a sub-pixel R, a sub-pixel G, a sub-pixel B and a sub-pixel Y.

Alternatively, the voltage calculation module comprises:

a first calculation unit for querying a voltage value corresponding to each brightness value according to a preset correspondence between the brightness values and the voltage values;

a voltage selection unit for selecting, for each type of sub-pixel, a maximum voltage value from N voltage values corresponding to N brightness values of this type of sub-pixel;

a second calculation unit for calculating the analog power supply voltage according to the maximum voltage values of the sub-pixels of different types selected by the voltage selection unit.

Alternatively, said analog power supply voltage $V_{AVDD}$ is that $V_{AVDD}=k*\text{Max}(V_{S_{1max}}+V_{S_{2max}}+\ldots+V_{S_{nmax}})+b$;

wherein it is assumed that sub-pixels of different types are $S_1, S_2, \ldots S_n$ respectively; the maximum voltage values corresponding to sub-pixels of respective types are $V_{S_{1max}}$, $V_{S_{2max}}, \ldots, V_{S_{nmax}}$ respectively; n is the number of sub-pixel types, and k and b are constants.

Alternatively, the apparatus further comprises:

a first calculation module for calculating, for each pixel data, a total brightness value of the pixel corresponding to the pixel data according to the brightness values of respective sub-pixels in the pixel corresponding to the pixel data;

a number determination module for determining the number of total brightness values higher than a preset threshold among N total brightness values calculated by the first calculation module;

a brightness value reduction module for, if a ratio of the number determined by the number determination module to N is less than a preset ratio, reducing the total brightness values higher than the preset threshold to the preset threshold;

a second calculation module for calculating brightness values of respective sub-pixels in the corresponding pixel after the total brightness values are reduced to the preset threshold by the luminance value reduction module.

Alternatively, the apparatus further comprises:

a brightness value selection module for selecting, for each type of sub-pixel, the maximum brightness value from N brightness values corresponding to this type of sub-pixel;

a gray scale calculation module for calculating, for each pixel data, a gray scale output value of this type of sub-pixel corresponding to the pixel data, according to the maximum brightness value selected by the luminance value selection module, the brightness value of this type of sub-pixel corresponding to each pixel data and the number of bits of the pixel data.

According to a third aspect of embodiments of the present disclosure, there is provided a display driving apparatus, comprising: a processor; a memory; and computer program instructions stored in the memory, the computer program instructions, when being executed by the processor, performing steps of: acquiring pixel data of N pixels, N=i*j, i being a coefficient and being a positive integer, and j being the number of pixels in each row; determining, for each pixel data, brightness values of respective sub-pixels in a pixel corresponding to the pixel data; calculating an analog power supply voltage of a source driver chip of a display module according to respective brightness values, the analog power supply voltage being positively correlated with the brightness values.

According to a fourth aspect of embodiments of the present disclosure, there is provided a display device, comprising the display driving apparatus disclosed in the second aspect or any one possible implementation of the second aspect.

The embodiments of present disclosure determines, for each pixel data, brightness values of respective sub-pixels in a pixel corresponding to each pixel data, after acquiring the pixel data of N pixels, and then calculates the analog power supply voltage of the source driver chip according to the brightness value required actually. Since the calculated analog power supply voltage is usually lower than the voltage corresponding to the maximum brightness, the scheme described above solves the problem that the power consumption of the source driver chip is high in the prior art by way of reducing the analog power supply voltage, and thus achieves the effect that the power consumption of the source driver chip may be reduced and the service life of the source driver chip is thereby prolonged.

BRIEF DESCRIPTION OF THE DRAWINGS

In order to explain the technical schemes in embodiments of the present disclosure more clearly, attached drawings to be used in the description of embodiments will be introduced simply in the following. Apparently, the attached drawings described below are only some embodiments of the present disclosure. It is possible for those of ordinary skill in the art to obtain other attached drawings according to these attached drawings on the premise of paying no creative work.

DETAILED DESCRIPTION

In order to make the object, technical schemes and advantages of the present disclosure more clear, implementations of the present disclosure will be described in more detail in conjunction with attached drawings in the following.

For better understanding, first of all, the implementation scenario to which display driving methods provided by various embodiments of the present disclosure relate will be introduced simply.

Figure 1:
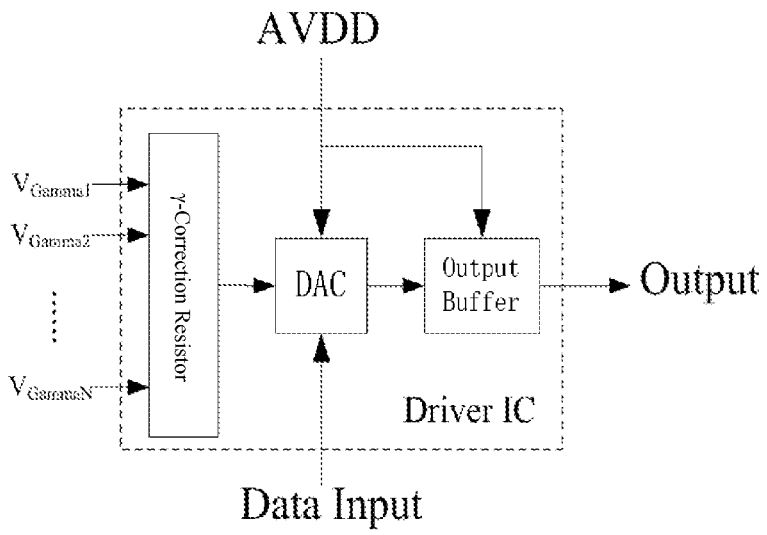
FIG. 1 is a schematic diagram of an implementation scenario to which display driving methods provided by various embodiments of the present disclosure relate.

Please refer to FIG. 1 which shows a structural schematic diagram of a source driver chip (Driver IC) of a display module. As shown in FIG. 1, $V_{Gamma1}$ to $V_{GammaN}$ are input reference voltages of a γ-Correction Resistor, AVDD is an analog power supply voltage of DAC (Digital to analog converter) and Output Buffer, Data Input is a digital input value of DAC, and Output is an analog output voltage of Output Buffer.

When the source driver chip operates, the power consumption of AVDD is that:

$$P_{AVDD}=C_{load}*F_{Data}\times V_{AVDD}^2$$

wherein, $C_{load}$ represents the load of Data Line, $F_{Data}$ is the change frequency of Data, and $V_{AVDD}$ is the voltage of AVDD.

The voltage value of AVDD is positively correlated with the maximum brightness desired to be displayed, and AVDD is usually set at the voltage corresponding to the maximum brightness for ensuring that the display can be performed with the maximum brightness. Thus, when the source driver chip operates at the voltage corresponding to the maximum brightness, the power consumption of the source driver chip is high.

Figure 2:
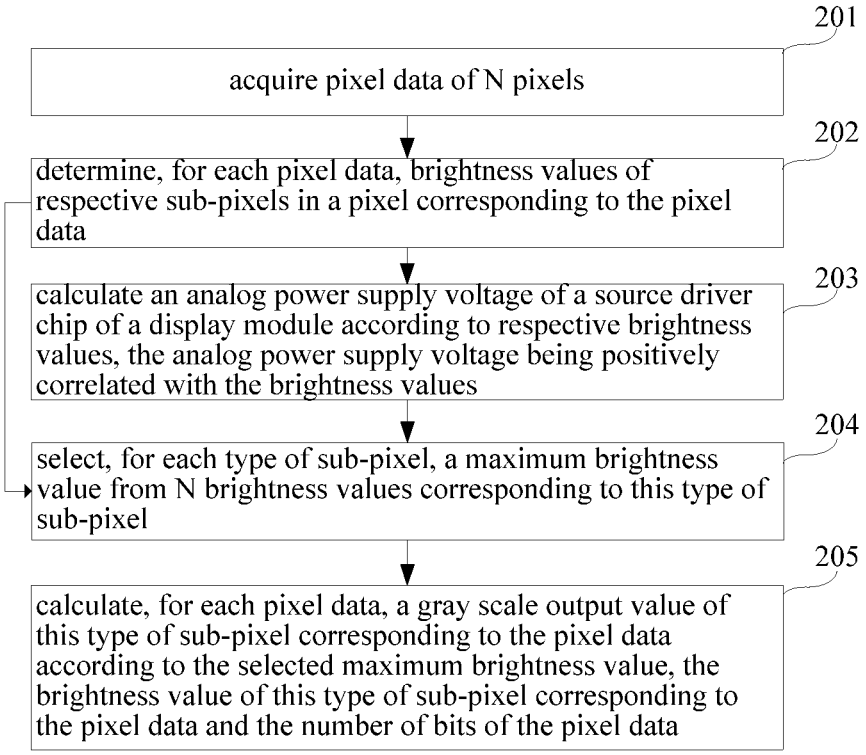
FIG. 2 is a flowchart of a display driving method provided by one embodiment of the present disclosure.

Please refer to FIG. 2 which shows a flowchart of a display driving method provided by one embodiment of the present disclosure. As shown in FIG. 2, the display driving method may include the following steps.

At step 201, pixel data of N pixels are acquired.

N=i*j, i is a coefficient and is a positive integer, and j is the number of pixels in each row. For example, taking the resolution of a display screen being 1024×768 as an example, when i=2, pixel data of 2×1024 pixels may be acquired.

The pixel data may be an input signal in RGB format, in RGBW format, or in RGBY format. Also, the number of bits of the pixel data may be 6 bit, 8 bit, 10 bit or 12 bit, which is not limited by the present embodiment.

At step 202, for each pixel data, brightness values of respective sub-pixels in a pixel corresponding to the pixel data are determined.

Alternatively, the present step may include converting a gray scale input value in each pixel data into brightness values of at least three types of sub-pixels. The at least three types of sub-pixels include: a sub-pixel R, a sub-pixel G and a sub-pixel B; or a sub-pixel R, a sub-pixel G, a sub-pixel B and a sub-pixel W; or a sub-pixel R, a sub-pixel G, a sub-pixel B and a sub-pixel Y.

Taking the pixel data being a signal in RGB format in the existing standard and the at least three types of sub-pixels are four types of sub-pixels in RGBW, the present step may include the following steps.

(1) Gray scale signals $R_1$, $G_1$ and $B_1$ of R, G and B components in the RGB input signal are converted into their corresponding brightness $L_R'$, $L_G'$ and $L_B'$.

Figure 3A:
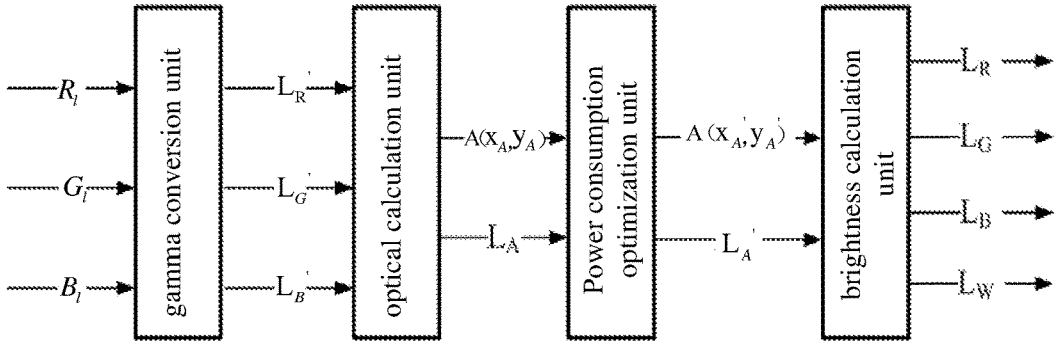
FIG. 3A is a schematic diagram when the gray scale is converted into the brightness provided by one embodiment of the present disclosure.

Specifically, please refer to FIG. 3A, in which the gray scale signals $R_1$, $G_1$ and $B_1$ are input to a gamma conversion unit, which converts the gray scale into the brightness.

(2) the color coordinates (A $(x_A,y_A)$) of a point A (an arbitrary point) in a display plane and the brightness value $L_A$ of the point A are calculated according to $L_R'$, $L_G'$ and $L_B'$.

In connection with FIG. 3A, $L_R'$, $L_G'$ and $L_B'$ are input to an optical calculation unit, which may calculate the color coordinates of the point A and the brightness value of the point A according to $L_R'$, $L_G'$ and $L_B'$.

(3) The point A is moved toward a sub-pixel W, and the color coordinates (A $(x_A',y_A')$) of the moved point A and the brightness value $L_A'$ of the moved point A are calculated.

In connection with FIG. 3A, the color coordinates and the brightness value of the point A are input into a power consumption optimization unit, which may calculate the coordinates and the brightness value of the moved point A.

(4) Brightness values of a sub-pixel R, a sub-pixel G, a sub-pixel B and a sub-pixel W are calculated according to the coordinates of the moved point A, the brightness value of the moved point A and a replacement ratio of white.

Still in connection with FIG. 3A, a brightness calculation unit may output brightness values $L_R$, $L_G$, $L_B$ and $L_W$ of the sub-pixel R, the sub-pixel G, the sub-pixel B and the sub-pixel W in accordance with the above parameters.

Figure 3B:
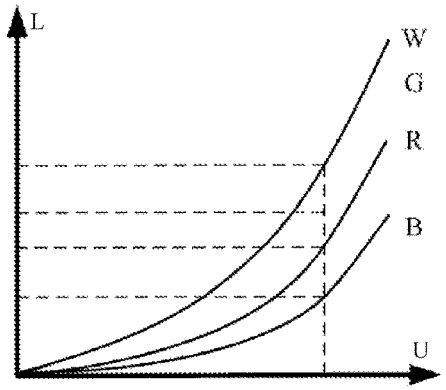
FIG. 3B is a diagram of the relationship between the brightness and the voltage for various sub-pixels provided by one embodiment of the present disclosure.

In addition, please refer to FIG. 3B, since a brightness order of the sub-pixel R, the sub-pixel G, the sub-pixel B and the sub-pixel W under a same voltage is the sub-pixel W>the sub-pixel G>the sub-pixel R>the sub-pixel B, the present embodiment achieves, by adding sub-pixels W, the effect of reducing the analog power supply voltage of the source driver chip under a same brightness and decreasing the power consumption of the source driver chip in turn.

It should be noted that the present embodiment only uses calculating brightness values after acquiring N pixel data as an example for explanation t. Alternatively, it is also possible to calculate the brightness value according to one pixel data each time when the pixel data is acquired, which is not limited by the present embodiment.

At step 203, the analog power supply voltage of a source driver chip of a display module is calculated according to respective brightness values, the analog power supply voltage being positively correlated with the brightness values.

Specifically, the step may be performed by the following processes.

(i). The voltage value corresponding to each brightness value is queried according to a preset correspondence between the brightness values and the voltage values.

(ii). For each type of sub-pixel, the maximum voltage value is selected from N voltage values corresponding to N brightness values of this type of sub-pixel.

Brightness values of N sub-pixels of a same type may be determined by N pixel data, that is, N voltage values corresponding to brightness values of N sub-pixels of a same type may be obtained after the process (i). Thereafter, for each type of sub-pixels, the maximum voltage value may be selected from the N voltage values obtained.

For example, still taking sub-pixels being four types of sub-pixels in RGBW as an example for explanation. The selected maximum voltage value corresponding to the sub-pixel R is $V_{R\ max}$, the selected maximum voltage value corresponding to the sub-pixel G is $V_{G\ max}$, the selected maximum voltage value corresponding to the sub-pixel B is $V_{B\ max}$, and selected maximum voltage value corresponding to the sub-pixel W is $V_{W\ max}$.

(iii). The analog power supply voltage is calculated according to the selected maximum voltage values of the sub-pixels of different types.

The analog power supply voltage is positively correlated with the brightness values.

Specifically, the process (iii) may include the following processes.

(1) It is assumed that respective types of sub-pixels are $S_1$, $S_2$, . . . $S_n$ respectively, and maximum voltage values corresponding to respective types of sub-pixels are $V_{S_{1max}}$, $V_{S_{2max}}$, . . . , $V_{S_{nmax}}$.

(2) The analog power supply voltage $V_{AVDD}$ is that $V_{AVDD}=k*\mathrm{Max}\ (V_{S_{1max}}+V_{S_{2max}}+\ .\ .\ .\ +V_{S_{nmax}})+b$.

Wherein n is the number of sub-pixel types, and k and b are constants. Usually, k may take 1, and b may take 0.2.

For example, when maximum voltage values corresponding to respective types of sub-pixels are $V_{R\ max}$, $V_{G\ max}$, $V_{B\,max}$ and $V_{W\,max}$, the analog power supply voltage of the source driver chip is $V_{AVDD}$=k*Max ($V_{Rmax}$+$V_{Gmax}$+$V_{Bmax}$+$V_{Wmax}$)+b.

Alternatively, the display driving method according to the present embodiment may further include the following steps.

At step 204, for each type of sub-pixel, the maximum brightness value is selected from N brightness values corresponding to this type of sub-pixel.

After the brightness values of respective sub-pixels in the pixel corresponding to each pixel data is determined, for each type of sub-pixel, the maximum brightness value may be selected from N brightness values corresponding to this type of sub-pixel.

For example, sub-pixels being four types of sub-pixels in RGBW are still taken as an example for explanation. For the sub-pixel R, the maximum brightness value selected from N brightness values is $L_{Rmax}$; for the sub-pixel G, the maximum brightness value selected from N brightness values is $L_{Gmax}$; for the sub-pixel B, the maximum brightness value selected from N brightness values is $L_{Bmax}$; for the sub-pixel W, the maximum brightness value selected from N brightness values is $L_{Wmax}$.

At step 205, for each pixel data, a gray scale output value of said type of sub-pixel corresponding to the pixel data is calculated according to the selected maximum brightness value, the brightness value of said type of sub-pixel corresponding to the pixel data and the number of bits of the pixel data.

Specifically, the gray scale of a certain type of sub-pixel in the pixel data is $$\left(\frac{L}{L_{max}}\right)^{\frac{1}{\gamma}} * (2^n - 1),$$

in which L is the brightness of this type of sub-pixel in the current pixel data, $L_{max}$ is the selected maximum brightness value of this type of sub-pixel in N pixel data, γ is a coefficient, and n is the number of bits of the pixel data.

For example, sub-pixels being four types of sub-pixels in RGBW are taken as an example for explanation. Gray scale output values of four types of sub-pixels in each pixel data are $$R_o = \left(\frac{L_R}{L_{Rmax}}\right)^{\frac{1}{\gamma}} * (2^n - 1),$$

$$G_o = \left(\frac{L_G}{L_{Gmax}}\right)^{\frac{1}{\gamma}} * (2^n - 1),$$

$$B_o = \left(\frac{L_B}{L_{Bmax}}\right)^{\frac{1}{\gamma}} * (2^n - 1),$$

$$W_o = \left(\frac{L_W}{L_{Wmax}}\right)^{\frac{1}{\gamma}} * (2^n - 1)$$

respectively.

Alternatively, in practical implementation, there may be other calculation ways to calculate gray scale output values corresponding to respective sub-pixels in each pixel data. For example, after the maximum brightness values corresponding to respective sub-pixels are selected, a gamma curve may be generated firstly. Thereafter, gray scale output values corresponding to respective sub-pixels in each pixel data are queried according to the gamma curve.

Specifically, sub-pixels being four types of sub-pixels in RGBW are taken as an example for explanation. The gamma curve may be that:

$$\Gamma_R:\ R_g = \left(\frac{L_R}{L_{Rmax}}\right)^{\frac{1}{\gamma}} * (2^n - 1);$$

$$\Gamma_G:\ G_g = \left(\frac{L_G}{L_{Gmax}}\right)^{\frac{1}{\gamma}} * (2^n - 1);$$

$$\Gamma_B:\ B_g = \left(\frac{L_B}{L_{Bmax}}\right)^{\frac{1}{\gamma}} * (2^n - 1);$$

$$\Gamma_W:\ W_g = \left(\frac{L_W}{L_{Wmax}}\right)^{\frac{1}{\gamma}} * (2^n - 1).$$

In addition, the first point to be noted additionally is that the present embodiment only takes performing step 204 and step 205 after step 203 as an example. Alternatively, step 204 and step 205 may also be performed after step 202, and the actual order for performing them is not limited by the present embodiment.

The second point to be noted additionally is that, after the analog power supply voltage is set, a gamma voltage needs to be adaptively set, that is, gamma voltages ($G_R$, $G_G$, $G_B$, $G_W$) of respective types of sub-pixels need to be adaptively set. Specifically, there may be m gamma voltages for each type of sub-pixel, and each gamma voltage is $$G = \left(\frac{X_z}{2^n - 1}\right)^{\gamma} \times V_{max},$$

in which $X_z$ is a preset constant, Z takes a value from 0 to m, and $V_{max}$ is the maximum voltage value among N voltage values corresponding to said type of sub-pixel.

For example, taking gamma voltages of a red sub-pixel being set and the number of gamma voltages being 9 as an example, gamma voltages of the red sub-pixel may be respectively:

$$G_{R0} = \left(\frac{X_0}{2^n - 1}\right)^{\gamma} \times V_{Rmax};$$

$$G_{R1} = \left(\frac{X_1}{2^n - 1}\right)^{\gamma} \times V_{Rmax};$$

$$G_{R2} = \left(\frac{X_2}{2^n - 1}\right)^{\gamma} \times V_{Rmax};$$

$$G_{R3} = \left(\frac{X_3}{2^n - 1}\right)^{\gamma} \times V_{Rmax};$$

$$G_{R4} = \left(\frac{X_4}{2^n - 1}\right)^{\gamma} \times V_{Rmax};$$

$$G_{R5} = \left(\frac{X_5}{2^n - 1}\right)^{\gamma} \times V_{Rmax};$$

$$G_{R6} = \left(\frac{X_6}{2^n - 1}\right)^{\gamma} \times V_{Rmax};$$

$$G_{R7} = \left(\frac{X_7}{2^n - 1}\right)^{\gamma} \times V_{Rmax};$$

$$G_{R8} = \left(\frac{X_8}{2^n - 1}\right)^{\gamma} \times V_{Rmax}.$$

Wherein $X_0$=0, $X_1$=32, $X_2$=64, $X_3$=96, $X_4$=128, $X_5$=160, $X_6$=192, $X_7$=224, $X_8$=255. γ is a coefficient, and n is the number of bits of the pixel data. Also, the explanation is made by taking the values of $X_0$ to $X_8$ being the above values as only an example. However, in practical implementation, they may be other values, which are not limited by the present embodiment. Furthermore, the explanation is made by taking the number of gamma voltages of a same type of sub-pixel being 9 only as an example in the present embodiment. Alternatively, the number of gamma voltages may also be more or less, and the number is not limited by the present embodiment.

Figure 3C:
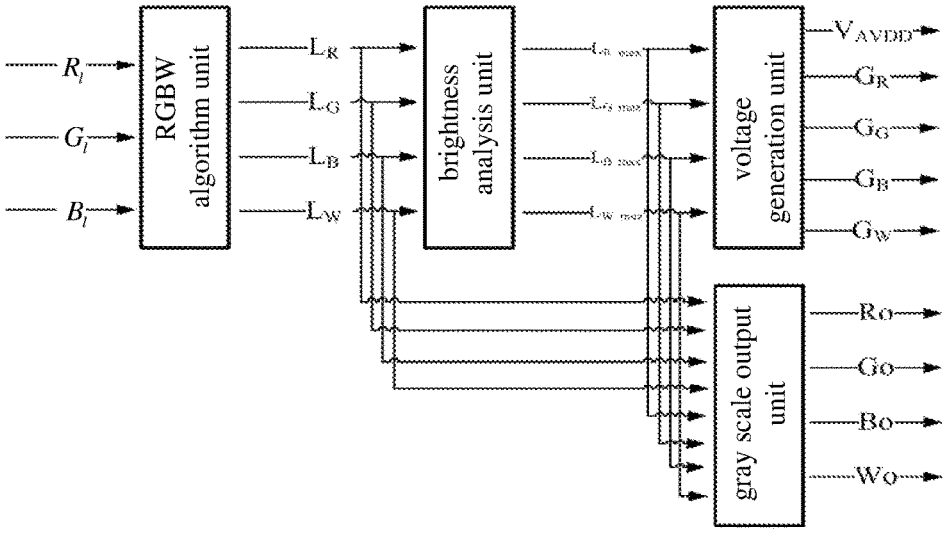
FIG. 3C is a schematic diagram of respective units for implementing the display driving method provided by one embodiment of the present disclosure.

In one application scenario of the present embodiment, the explanation is made by taking the pixel data being a signal in RGB format and the at least three sub-pixels being four types of sub-pixels in RGBW as an example. Please refer to FIG. 3C, in which after gray scales $R_1$, $G_1$ and $B_1$ of each of N pixel data are input to a RGBW algorithm unit, the RGBW algorithm unit converts gray scales in each pixel data into brightness value $L_R$ of a sub-pixel R, brightness value $L_G$ of a sub-pixel G, brightness value $L_B$ of a sub-pixel B and brightness value $L_W$ of a sub-pixel W. Thereafter, the brightness values corresponding to the N pixel data are input to a brightness analysis unit, and the brightness analysis unit selects the maximum brightness values $L_R$ max, $L_{G\ max}$, $L_{B\ max}$ and $L_{W\ max}$ from brightness values corresponding to each type of sub-pixel. A voltage generation unit calculates $V_{AVDD}$ and $G_R$, $G_G$, $G_B$, $G_W$ according to the selected maximum brightness values of respective sub-pixels. After brightness values of respective sub-pixels in the pixels corresponding to respective pixel data are calculated in the RGBW algorithm unit, and, for each type of sub-pixel, the maximum brightness value among N brightness values corresponding to this type of sub-pixel is obtained in the brightness analysis unit by analysis, a gray scale output unit may determine the output value of the gray scale corresponding to each type of sub-pixel in each pixel data according output results of the RGBW algorithm unit and the brightness analysis unit. The RGBW algorithm unit in FIG. 3C may include the gamma conversion unit, the optical calculation unit, the power consumption optimization unit and the brightness calculation unit as shown in FIG. 3A.

In summary, the display driving method provided by the present embodiment determines, for each pixel data, brightness values of respective sub-pixels in a pixel corresponding to the pixel data, after pixel data of N pixels are acquired, and then calculates the analog power supply voltage of the source driver chip according to the brightness value required actually. Since the calculated analog power supply voltage is usually lower than the voltage corresponding to the maximum brightness, the scheme described above solves the problem that the power consumption of the source driver chip is high in the prior art by way of reducing the analog power supply voltage, and thus achieves the effect that the power consumption of the source driver chip may be reduced and the service life of the source driver chip is thereby prolonged.

Figure 3D:
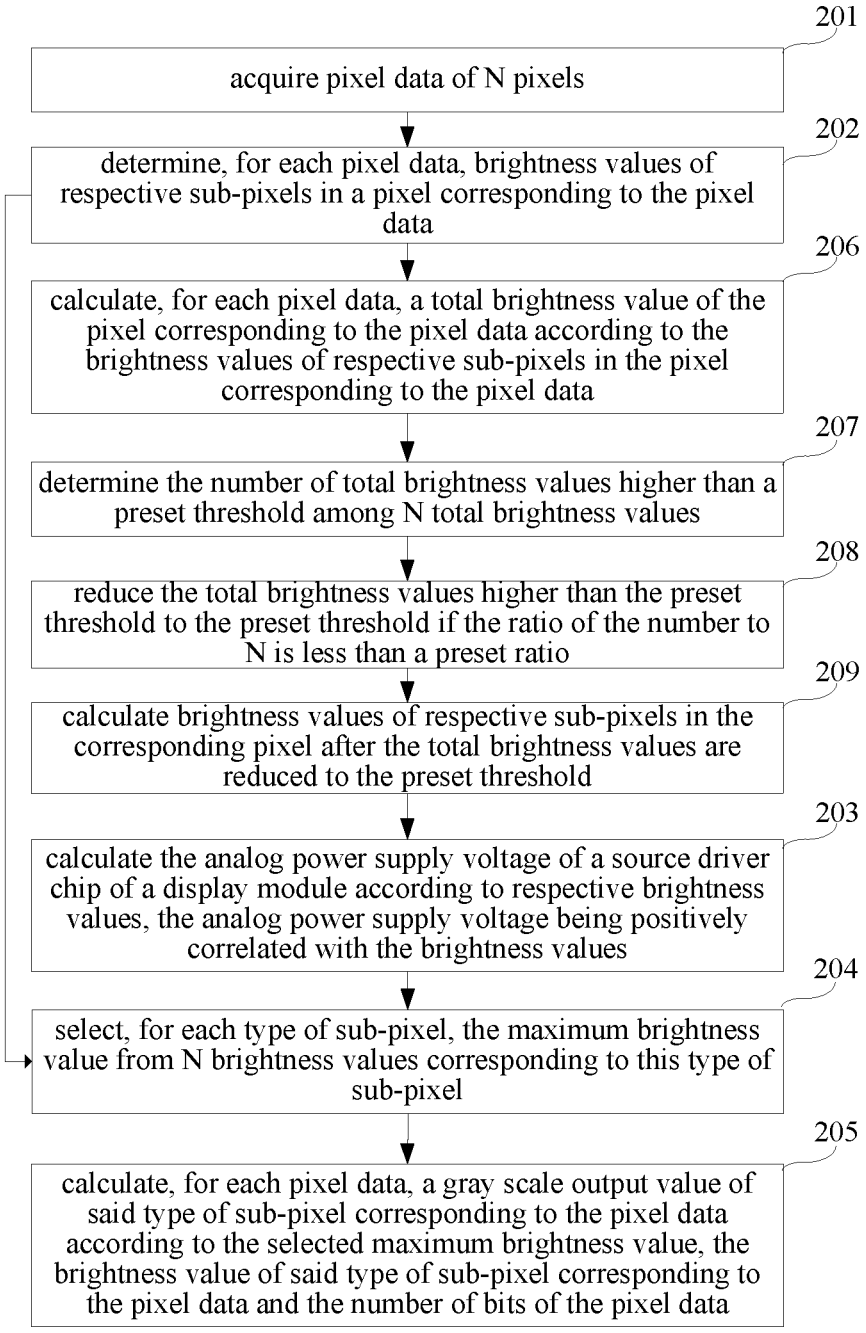
FIG. 3D is a flowchart of another display driving method provided by one embodiment of the present disclosure.

It should be noted additionally that, referring to FIG. 3D, before step 203, the following steps may also be performed.

At step 206, for each pixel data, a total brightness value of the pixel corresponding to the pixel data is calculated according to the brightness values of respective sub-pixels in the pixel corresponding to the pixel data.

Taking respective sub-pixels being four types of sub-pixels in RGBW as an example, brightness values of four types of sub-pixels in the pixel data are $L_R$, $L_G$, $L_B$, $L_W$ respectively, and accordingly the total brightness value of the pixel corresponding to the pixel data may be $L_R+L_G+L_B+L_W$.

At step 207, the number of total brightness values higher than a preset threshold among N total brightness values is determined.

The preset threshold is a relatively high brightness value. For example, taking the supported maximum brightness being 1 lumen as an example, the preset threshold may take 0.9 lumens.

At step 208, the total brightness values higher than the preset threshold are reduced to the preset threshold if the ratio of the number to N is less than a preset ratio.

To ensure the original display effect, the preset ratio is usually a small preset value. For example, the preset ratio may be 5% or 1%.

Figure 3E:
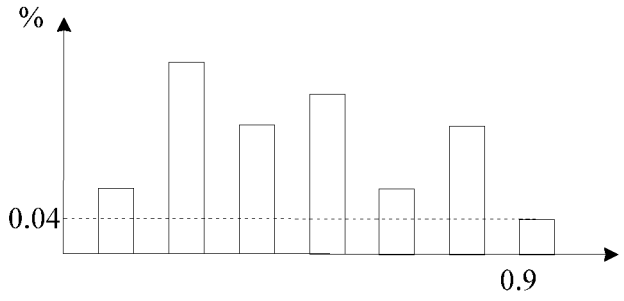
FIG. 3E is a schematic diagram of distribution of total brightness values of N pixels provided by one embodiment of the present disclosure.
Figure 3F:
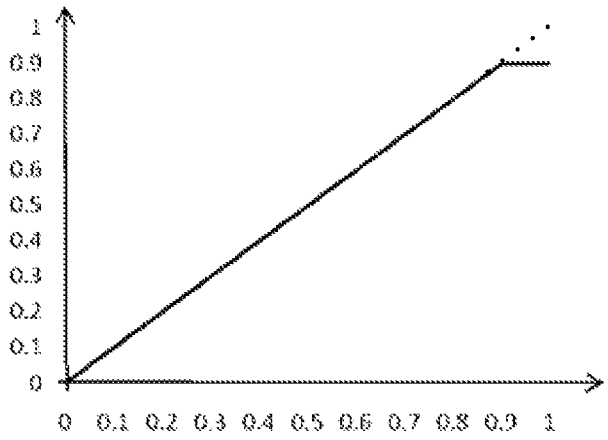
FIG. 3F is a schematic diagram of reducing a total brightness value higher than a preset threshold to the preset threshold provided by one embodiment of the present disclosure.

In connection with FIG. 3E, the ratio of the number of total brightness values higher than 0.9 lumens among N total brightness values to N is 4%, which is less than the preset ratio of 5%. Thus, referring to FIG. 3F, it is possible to reduce respective total brightness values higher than 0.9 lumens to 0.9 lumens.

At step 209, brightness values of respective sub-pixels in the corresponding pixel are calculated after the total brightness values are reduced to the preset threshold.

The ratios between brightness values of respective sub-pixels in one pixel remain unchanged. After the total brightness value of the pixel is reduced to the preset threshold, brightness values of respective sub-pixels may be calculated according to the ratios between brightness values of respective sub-pixels.

By reducing the total brightness values higher than the preset threshold to the preset threshold when total brightness values of the pixels are higher than the preset threshold and the proportion of the number of total brightness values higher than the preset threshold is relatively small, an effect is achieved that the analog power supply voltage of the source driver chip is reduced by reducing the brightness and thus the power consumption is reduced under the premise of not affecting the display effect. Meanwhile, by reducing total brightness values higher than the preset threshold to the preset threshold, that is, by reducing the total brightness of pixels to be displayed, the effect that the power consumption of the light emitting layer may be reduced and thus the service life of the light emitting layer may be prolonged is achieved.

Figure 4:
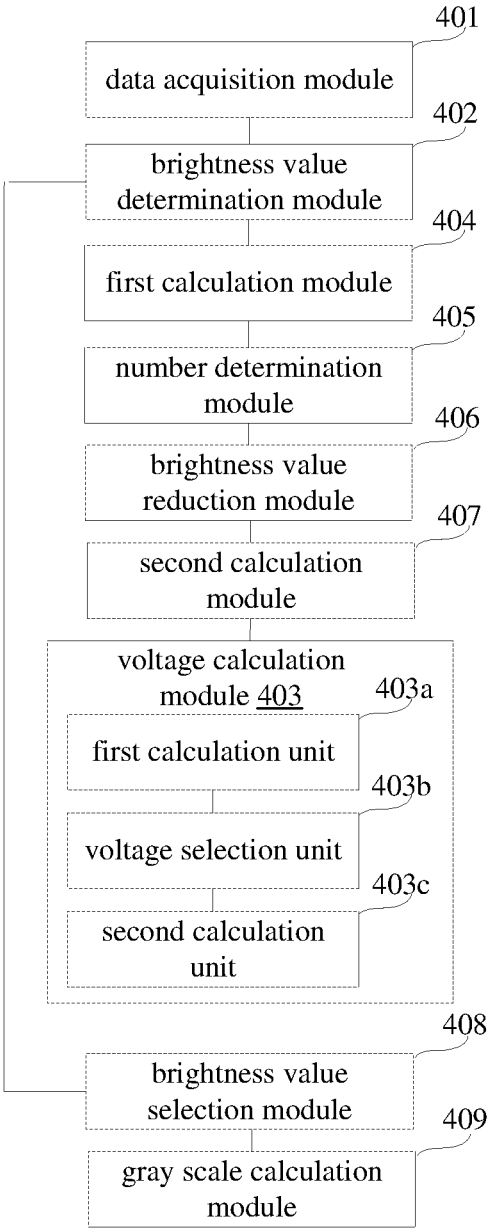
FIG. 4 is a structural schematic diagram of a display driving apparatus provided by one embodiment of the present disclosure.

Please refer to FIG. 4 which shows a structural schematic diagram of a display driving apparatus provided by one embodiment of the present disclosure. As shown in FIG. 4, the display driving apparatus may include a data acquisition module 401, a brightness value determination module 402 and a voltage calculation module 403.

The data acquisition module 401 is used for acquiring pixel data of N pixels, N=i*j, i being a coefficient and being a positive integer, and j being the number of pixels in each row.

The brightness value determination module 402 is used for determining, for each pixel data acquired by the data acquisition module 401, brightness values of respective sub-pixels in a pixel corresponding to the pixel data.

The voltage calculation module 403 is used for calculating an analog power supply voltage of a source driver chip of a display module according to respective brightness values determined by the brightness value determination module 402, the analog power supply voltage being positively correlated with the brightness values.

Alternatively, the brightness value determination module 402 is further used for converting a gray scale input value in each pixel data into brightness values of at least three types of sub-pixels, the at least three types of sub-pixels including:

a sub-pixel R, a sub-pixel G and a sub-pixel B; or a sub-pixel R, a sub-pixel G, a sub-pixel B and a sub-pixel W; or a sub-pixel R, a sub-pixel G, a sub-pixel B and a sub-pixel Y.

Alternatively, the voltage calculation module 403 includes: a first calculation unit 403*a* for querying a voltage value corresponding to each brightness value according to a preset correspondence between the brightness values and the voltage values; a voltage selection unit 403*b* for selecting, for each type of sub-pixel, a maximum voltage value from N voltage values corresponding to N brightness values of this type of sub-pixel; a second calculation unit 403*c* for calculating the analog power supply voltage according to the maximum voltage values of the sub-pixels of different types selected by the voltage selection unit 403*b*.

Alternatively, it may be assumed that sub-pixels of different types are $S_1$, $S_2$, . . . $S_n$ respectively, the maximum voltage values corresponding to sub-pixels of respective types are $V_{S_{1max}}$, $V_{S_{2max}}$, . . . , $V_{S_{nmax}}$ respectively, and then the analog power supply voltage $V_{AVDD}$ is that $V_{AVDD}=k*\mathrm{Max}(V_{S_{1max}}+V_{S_{2max}}+\ .\ .\ .\ +V_{S_{nmax}})+b$, n being the number of sub-pixel types and k and b being constants.

Alternatively, the apparatus further includes: a first calculation module 404 for calculating, for each pixel data, the total brightness value of the pixel corresponding to the pixel data according to the brightness values of respective sub-pixels in the pixel corresponding to the pixel data; a number determination module 405 for determining the number of total brightness values higher than a preset threshold among N total brightness values calculated by the first calculation module 404; a brightness value reduction module 406 for reducing the total brightness values higher than the preset threshold to the preset threshold if the ratio of the number determined by the number determination module 405 to N is less than a preset ratio; and a second calculation module 407 for calculating brightness values of respective sub-pixels in the corresponding pixel after the total brightness values are reduced to the preset threshold by the brightness value reduction module 406.

Alternatively, the apparatus further includes: a brightness value selection module 408 for selecting, for each type of sub-pixel, the maximum brightness value from N brightness values corresponding to this type of sub-pixel; and a gray scale calculation module 409 for calculating, for each pixel data, a gray scale output value of the type of sub-pixel corresponding to each pixel data, according to the maximum brightness value selected by the brightness value selection module 408, the brightness of the type of sub-pixel corresponding to each pixel data and the number of bits of the pixel data.

In summary, the display driving apparatus provided by the present embodiment determines, for each pixel data, brightness values of respective sub-pixels in a pixel corresponding to the pixel data, after pixel data of N pixels are acquired, and then calculates the analog power supply voltage of the source driver chip according to the brightness value required actually. Since the calculated analog power supply voltage is usually lower than the voltage corresponding to the maximum brightness, the scheme described above solves the problem that the power consumption of the source driver chip is high in the prior art by way of reducing the analog power supply voltage, and thus achieves the effect that the power consumption of the source driver chip may be reduced and that the service life of the source driver chip is thereby prolonged.

By reducing the total brightness values higher than the preset threshold to the preset threshold when total brightness values of the pixels are higher than the preset threshold and the proportion of the number of total brightness values higher than the preset threshold is relatively small, an effect is achieved that the analog power supply voltage of the source driver chip is reduced by reducing the brightness and thus the power consumption is reduced under the premise of not affecting the display effect. Meanwhile, by reducing total brightness values higher than the preset threshold to the preset threshold, that is, by reducing the total brightness of pixels to be displayed, the effect that the power consumption of the light emitting layer may be reduced and thus the service life of the light emitting layer may be prolonged is achieved.

The present disclosure further provides a display device which includes the display driving apparatus as shown in FIG. 4.

In summary, the display device provided by the present embodiment determines, for each pixel data, brightness values of respective sub-pixels in a pixel corresponding to the pixel data, after pixel data of N pixels are acquired, and then calculates the analog power supply voltage of the source driver chip according to the brightness value required actually. Since the calculated analog power supply voltage is usually lower than the voltage corresponding to the maximum brightness, the scheme described above solves the problem that the power consumption of the source driver chip is high in the prior art by way of reducing the analog power supply voltage, and thus achieves the effect that the power consumption of the source driver chip may be reduced and that the service life of the source driver chip is thereby prolonged. In addition, since the analog power supply voltage of the source driver chip is lower than the voltage of the maximum brightness, the current flowing through the light emitting layer in the actual operation procedure of the source driver chip is reduced accordingly, and thus the service life of the light emitting layer is prolonged.

The serial numbers of above embodiments of the present disclosure are only for the purpose of description but not represent that the embodiment is superior or inferior.

It should be understood by those of ordinary skill in the art that steps for implementing all or part of the embodiments described above may be accomplished by hardware, or may be accomplished by related hardware instructed by a program which may be stored in a type of computer readable storage medium. The storage medium mentioned above may be a read only memory, a magnetic disk, a compact disk, etc.

The descriptions above are only preferred embodiments of the present disclosure but not used to limit the present disclosure. Any amendment, equivalent substitution, improvement made within the spirit and the principle of the present disclosure should all be contained in the protection scope of the present disclosure.

What is claimed is:

1. A display driving method for a display device, comprising:

for N pixels, N=i*j, i being a coefficient and being a positive integer, and j being a number of pixels in each row, receiving pixel data of each of the N pixels, and each time the pixel data of a pixel is received, determining in real time, for the received pixel data of the pixel, brightness values of respective sub-pixels of the pixel, wherein each of the N pixels comprises a sub-pixel R, a sub-pixel G, a sub-pixel B, and either a sub-pixel W or a sub-pixel Y;

determining in real time an analog power supply voltage of a source driver chip of a display module according to the brightness values of the N pixels, the analog power supply voltage being positively correlated with the brightness values of the sub-pixels, wherein before said determining in real time the analog power supply voltage of the source driver chip of a display module according to the brightness values, the method further comprises:

determining, for the received pixel data, a total brightness value of the pixel corresponding to the received pixel data according to the brightness values of the sub-pixels in the pixel that corresponds to the received pixel data;

determining a number of total brightness values higher than a preset threshold among N total brightness values;

reducing, when a ratio of the number to N is less than a preset ratio, the total brightness values higher than the preset threshold to the preset threshold; and determining brightness values of the sub-pixels in the pixel that corresponds to the received pixel data after the total brightness values are reduced to the preset threshold.

2. The method according to claim 1, wherein said determining the analog power supply voltage of the source driver chip of a display module according to the brightness values of the N pixels comprises:

querying a voltage value corresponding to each of the brightness values according to a preset correspondence between the brightness values and voltage values;

selecting, for each type of sub-pixel, a maximum voltage value from N voltage values corresponding to N brightness values of the type of sub-pixel;

calculating the analog power supply voltage according to the selected maximum voltage values of the sub-pixels of the types that are different.

3. The method according to claim 2, wherein said analog power supply voltage $V_{AVDD}$ is that $V_{AVDD}=k*\mathrm{Max}\,(V_{s_{1max}}+V_{s_{2max}}+\ldots+V_{s_{nmax}})+b$;

wherein it is assumed that the sub-pixels of the types that are different are $S_i$, $S_2$, . . . $S_n$, respectively; the maximum voltage values corresponding to the sub-pixels of the types are $V_{s_{1max}}$, $V_{s_{2max}}$, . . . $V_{s_{nmax}}$ respectively; n is a number of sub-pixel types, and k and b are constants.

4. The method according to claim 1, further comprising:

for each type of sub-pixel, selecting a maximum brightness value from N brightness values corresponding to the type of sub-pixel, and calculating, for each of the received pixel data, a gray scale output value of the type of sub-pixel corresponding to the received pixel data, according to the selected maximum brightness value, the brightness value of the type of sub-pixel corresponding to the received pixel data and a number of bits of the received pixel data.

5. A display driving apparatus, comprising:

a processor;

a memory; and computer program instructions stored in the memory, the computer program instructions, when being executed by the processor, performing steps of:

for N pixels, N=i*j, i being a coefficient and being a positive integer, and j being a number of pixels in each row, receiving pixel data of each of the N pixels, and each time the pixel data of a pixel is received, determining in real time, for the received pixel data of the pixel, brightness values of respective sub-pixels of the pixel, wherein each of the N pixels comprises a sub-pixel R, a sub-pixel G, a sub-pixel B, and either a sub-pixel W or a sub-pixel Y;

determining in real time an analog power supply voltage of a source driver chip of a display module according to the brightness values of the N pixels, the analog power supply voltage being positively correlated with the brightness values of the sub-pixels, wherein the computer program instructions, when being executed by the processor, further performs steps of:

determining, for the received pixel data, a total brightness value of the pixel corresponding to the received pixel data according to the brightness values of the sub-pixels in the pixel that corresponds to the received pixel data;

determining a number of total brightness values higher than a preset threshold among N total brightness values;

reducing, when a ratio of the number to N is less than a preset ratio, the total brightness values higher than the preset threshold to the preset threshold; and determining brightness values of the sub-pixels in the pixel that corresponds to the received pixel data after the total brightness values are reduced to the preset threshold.

6. The apparatus according to claim 5, wherein said determining the analog power supply voltage of the source driver chip of a display module according to the brightness values of the N pixels comprises:

querying a voltage value corresponding to each of the brightness values according to a preset correspondence between the brightness values and voltage values;

selecting, for each type of sub-pixel, a maximum voltage value from N voltage values corresponding to N brightness values of the type of sub-pixel;

calculating the analog power supply voltage according to the selected maximum voltage values of the sub-pixels of the types that are different.

7. The apparatus according to claim 6, wherein said analog power supply voltage $V_{AVDD}$ is that $V_{AVDD}=k*\mathrm{Max}\,(V_{s_{1max}}+V_{s_{2max}}+\ldots+V_{s_{nmax}})+b$ ;

wherein it is assumed that the sub-pixels of the types that are different types are $S_i$, $S_2$ ,. . . $S_n$ respectively; the maximum voltage values corresponding to the sub-pixels of the types are $V_{s_{1max}}$, $V_{S_{2max}}$, . . . , $V_{S_{nmax}}$ respectively; n is a number of sub-pixel types, and k and b are constants.

8. The apparatus according to claim 5, wherein the computer program instructions, when being executed by the processor, further perform steps of:

for each type of sub-pixel, selecting a maximum brightness value from N brightness values corresponding to the type of sub-pixel, and calculating, for each of the received pixel data, a gray scale output value of the type of sub-pixel corresponding to the received pixel data, according to the selected maximum brightness value, the brightness value of the type of sub-pixel corresponding to the received pixel data and a number of bits of the received pixel data.

9. A display device, comprising the display driving apparatus according to claim 5.

* * * * *